US011583028B2

(12) United States Patent
Voggenauer

(10) Patent No.: US 11,583,028 B2
(45) Date of Patent: Feb. 21, 2023

(54) SANDAL

(71) Applicant: Dirk Voggenauer, Prien (DE)

(72) Inventor: Dirk Voggenauer, Prien (DE)

( * ) Notice: Subject to any disclaimer, the term of this patent is extended or adjusted under 35 U.S.C. 154(b) by 75 days.

(21) Appl. No.: 17/100,670

(22) Filed: Nov. 20, 2020

(65) Prior Publication Data

US 2021/0153596 A1 May 27, 2021

(30) Foreign Application Priority Data

Nov. 22, 2019 (DE) ..... 10 2019 131 624.3

(51) Int. Cl.
*A43B 3/12* (2006.01)

(52) U.S. Cl.
CPC ..... *A43B 3/126* (2013.01); *A43B 3/12* (2013.01)

(58) Field of Classification Search
CPC ..... A43B 3/126; A43B 3/122; A43B 3/12
USPC ..... 36/11.5
See application file for complete search history.

(56) References Cited

U.S. PATENT DOCUMENTS 1,088,309 A 2/1914 Weidt
2,032,665 A * 3/1936 Riddock ..... A43B 3/126 36/11.5
2,090,675 A * 8/1937 Hadaway ..... A43B 3/126 36/43
2,112,884 A * 4/1938 Gillette ..... A43B 3/126 36/43
2,412,808 A 12/1946 Goldstein
3,121,962 A 2/1964 Gullo
4,200,997 A * 5/1980 Scheinhaus ..... A43C 11/1493 36/11.5
4,446,633 A * 5/1984 Scheinhaus ..... A43B 7/144 D2/916
4,793,075 A * 12/1988 Thatcher ..... A43C 11/1493 36/11.5
5,205,054 A 4/1993 York, Jr.
2011/0179674 A1* 7/2011 Heid ..... A61F 5/019 36/11.5
2014/0144048 A1* 5/2014 McDonald ..... A43B 3/126 36/103
2016/0007673 A1* 1/2016 McDonald ..... H01L 29/78 36/11.5

FOREIGN PATENT DOCUMENTS

DE 2821731 A1 8/1979
FR 952048 A 11/1948

* cited by examiner

*Primary Examiner* — Marie D Bays
(74) *Attorney, Agent, or Firm* — McCoy Russell LLP

(57) ABSTRACT

The present invention relates to a sandal, in particular a trekking sandal, that comprises a sole for forming a separation layer between a foot area and the floor and at least one strap that is connected to the sole and serves the fastening of a foot in the sandal. The sandal is characterized in that the strap forms a loop that is adapted to deflect a strap guided through the loop in a fastening region by fastening two strap sections to one another.

14 Claims, 7 Drawing Sheets

SANDAL

CROSS-REFERENCE TO RELATED APPLICATIONS

The present application claims priority to German Patent Application No. 10 2019 131 624.3, entitled "SANDAL", and filed on Nov. 22, 2019. The entire contents of the above-listed application is hereby incorporated by reference for all purposes.

TECHNICAL FIELD

The present invention relates to a sandal, in particular to a trekking sandal or outdoor sandal.

BACKGROUND AND SUMMARY

It is customary with this type of shoe that a sole of the sandal is held at a foot by means of flat bands (so-called straps) fastened to the sole. As a rule, there is here a strap section that substantially extends perpendicular from the sole plane and that is connected to a heel strap or rear foot strap and to an instep strap via a fastening element. In conjunction with the instep strap, the heel strap provides a fixing of the sandal at the foot. In this respect, the fastening element is frequently also used to deflect a strap to obtain a flexible width setting of the straps and to reduce the forces acting on the strap. In addition, there is as a rule a forefoot strap that is guided in the width direction of the foot and that fastens the front section of the sole to the foot. A typical sandal known from the prior art is shown in FIG. 1.

It is disadvantageous in the already known prior art that the strap design for surrounding the foot in the region below the ankle consists of a plurality of separate components that have to be joined together in complex production steps. It is furthermore often even necessary to inwardly shield the fastening element of a conventional sandal by a cushion or the like since it can produce unpleasant rubbing or an unpleasant pressure at a foot when wearing the sandal.

It is accordingly the aim of the present invention to provide a sandal that overcomes the above-listed disadvantages. This is done by a scandal that has all the features of claim 1. Advantageous embodiments can be found in the dependent claims.

The sandal in accordance with the invention, in particular a trekking sandal, accordingly comprises a sole for forming a separation layer between a foot area and a surface and at least one strap that is connected to the sole and serves the fastening or holding of a foot in the sandal, characterized in that the strap forms a loop in a fastening region by fastening two strap sections to one another, the loop being adapted to deflect a strap led through the loop.

The key to the invention is accordingly that a fastening element is not especially provided—as customary in the prior art—from where the holding straps arranged below an ankle start, but that rather the function of the fastening element is taken over by the strap itself that starts from the sole of the sandal. For this purpose, this strap is turned over and fixed toward an outer side of the sandal so that a loop is formed that serves the deflection of a strap. For instance, provision can be made, for example, on a presence of two straps arranged below the ankle (one respective strap is located at each width side of the sandal) having a respective loop that this loop is respectively used to deflect the other strap.

However, the invention also comprises the case according to which a sandal only comprises one strap forming a loop. It is thus by all means conceivable that the strap that forms the loop is also guided through just that loop after surrounding the foot.

Provision can be made in accordance with the invention that the strap extends substantially in a straight line, preferably substantially perpendicular, from the sole and includes an angle after the loop with the section extending from the sole that is in the range from 90° to 160°, preferably from 100° to 145°, more preferably from 110° to 130°, and very particularly preferably from 115° to 125°.

Provision can be made in accordance with an optional modification that the strap has a first planar side and a second planar side and the loop is formed such that the first planar side faces the second planar side in the fastening region, with the first planar side preferably contacting the second planar side.

The two strap sections fastened to one another are preferably adhesively bonded, welded, riveted, and/or sewn to one another to form the loop.

Provision can be made in accordance with the invention that the loop is a simple loop in which a section of the strap that is remote from the sole is formed by a simple turning over and attachment to a section of the strap close to the sole, preferably in that the remote section of the strap is twisted by 180° about its longitudinal extent and is fastened to a non-twisted near section. The loop can therefore be formed by rotating and placing to one side.

Provision is preferably made that the loop divides the strap into a proximal strap section that extends toward the loop, starting from the sole, and a distal strap section that extends from the loop toward an end region of the strap extending away from the sole, and the distal strap section has a first one of the two components of a strap fixing, for example of a hook and loop connection, in particular a hook tape, at one of its two planar sides and has, offset toward the distal end of the strap, the other of the two components of the strap fixing, for example a loop tape.

In addition to a hook and loop connection, a clasp, for example with a pin buckle, or also a press fastening can be provided as further possibilities of a strap fixing. Other types of buckles with belt buckles, hooks, and D rings are likewise possible to fix the strap.

Provision can be made in accordance with a further optional development of the invention that the loop is remote from a longitudinal axis of the sole, that is the strap forming the loop is turned over toward an outer side of the sole.

The leadthrough of the loop accordingly fades the outer side of the sole so that that part of the strap that comes from the sole of the sandal is bent toward an outer side of the sole so that the loop that is formed does not project in an irritating manner into the region for receiving the foot or ankle, but rather projects outwardly therefrom.

Provision can be made in accordance with a further modification of the invention that the strap is arranged in a rear region of the sole, preferably in the region around the heel reception of the sole, more preferably in a region at the inner side or the outer side of the sandal at an end of the heel reception facing a toe region.

Provision can furthermore be made in accordance with the invention that the loop of the strap is designed such that it is an opening wider than the width of the strap in a flattened state, preferably only a maximum of 20%, more preferably only a maximum of 10%, wider than the width of the strap.

Provision can preferably be made that a first one of the at least one strap, a so-called inner strap, and a second one of the at least one strap, a so-called outer strap, are present whose respective distal sections of the straps can be guided through the loop of the other strap to thereby achieve a deflection of the strap led through.

As a rule, a respective strap is provided in the rear region of the sole at oppositely disposed marginal regions in the width direction of the sole, said respective straps being arranged approximately below the ankle next to the foot to be received by the sole. The straps here typically extend out of the surface formed by the sole. Each of the straps here has the characteristic loop that is preferably placed to the outside, away from the reception region for the foot. The distal region of the two straps here extends in opposite directions; for example, the distal region of the outer strap extends, starting from the loop, to a front region of the sole, whereas the distal region of the inner strap is directed, starting from the loop, to the rear to a heel region of the sole.

Provision can furthermore be made in accordance with the invention that the inner strap is designed to be guided over the rear side of a foot above the heel in the region of the Achilles tendon and/or the outer strap is designed to be guided over an instep region of a foot. It can, however, equally be covered by the invention that the inner strap is guided over the instep and the outer strap is guided over the rear heel region. The loop of the inner strap is here preferably used to deflect the distal section of the outer strap and the loop of the outer strap is preferably used to deflect the distal section of the inner strap.

Provision can be made in accordance with a further optional modification of the invention that the inner strap is shorter in its longitudinal extent than the outer strap; the distal section of the inner strap that is subsequent to the loop of the strap is preferably shorter in its longitudinal extent than the distal section of the outer strap.

The sandal in accordance with the invention can furthermore be provided with a front foot fastening strap to fasten a front foot to the sandal.

Provision can furthermore be made that the sole has a multi-layer design with a layer facing the floor and a layer remote from the floor, with the at least one strap preferably being fastened between the two layers, more preferably in that the strap is led through the layer remote from the floor and is adhesively bonded between the layers.

Provision can preferably be made that the loops of the inner strap and of the outer strap of the one sandal of the pair of sandals are placed in one direction and the loops of the inner strap and of the outer strap of the other sandal of the pair of sandals are placed in the other direction. In other words, on a mutually parallel alignment of the proximal sections of straps of different sandals of a pair of sandals, the distal section of the strap is not placed at the same side, but rather at the respective other side.

BRIEF DESCRIPTION OF FIGURES

Further features, details and advantages of the invention will be explained with reference to the following description of the Figures. There are shown.

DETAILED DESCRIPTION

Figure 1:
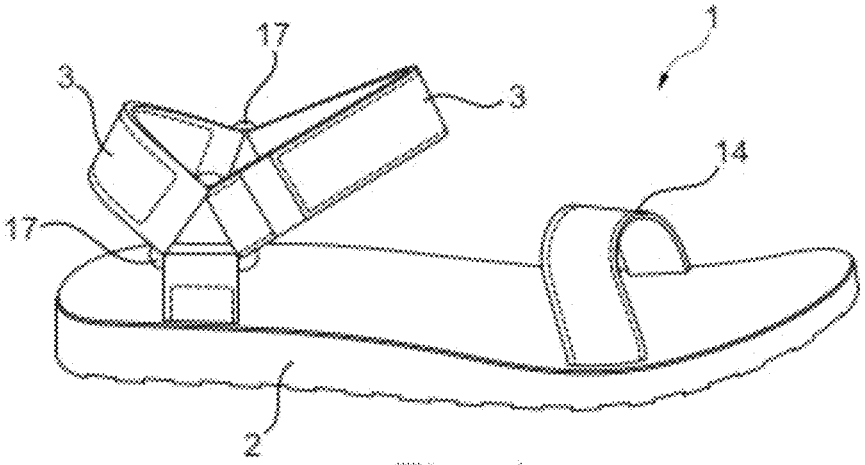
Fig. 1 Prior Art
FIG. 1: a sandal of the prior art in a side view.

FIG. 1 shows a sandal 1 from the prior art. It can be recognized that a respective strap 3 that is offset from the rear region of the sole 2 in the width direction of the sole 2 extends upwardly from the sole 2 and extends to a respective triangularly shaped fastening element 17. The two fastening elements 17 here serve the arrangement of the heel strap 3 and of the instep strap to fasten the sandal to a foot. The front foot fastening strap 14 likewise serves the fastening of the sandal 1 to the foot.

It is disadvantageous in the sandal 1 from the prior art that the fastening element and the straps 3 starting therefrom are designed in multiple parts and therefore require a complex production. Furthermore, a plurality of wearers perceive the direct putting on of the fastening elements 17 in the region below the ankle as unpleasant so that a cover is frequently provided with respect to the foot or a different shielding is provided. Finally, the fastening element is produced from a rigid, non-flexible material that can rub unpleasantly at the foot on a walking movement of the foot.

Figure 2:
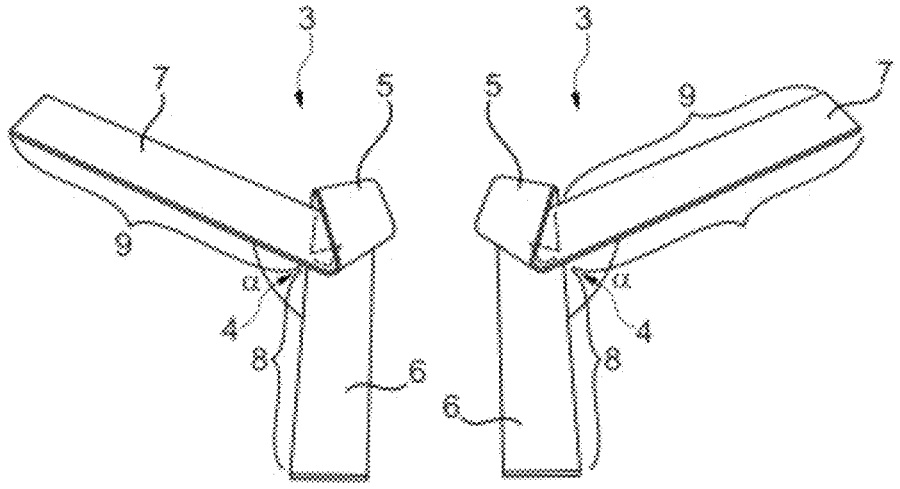
FIG. 2: an illustration of two straps of the invention whose distal sections are placed at different sides.

FIG. 2 shows two different straps 3 of the sandal 1 in accordance with the invention. The two straps 3 only differ here by the direction in which the distal section 9 has been placed. The strap 3 shown at the left in FIG. 2 is thus provided with a loop 5 placed to the left, whereas the strap 3 shown at the right in FIG. 2 is provided with a loop 5 placed to the right.

Each strap 3 here has a loop 5 that has been produced by fastening two sections of the strap 3. Two sections spaced apart from one another in the longitudinal direction of the strap 3 are connected to one another in the fastening region 4 of the strap 3 so that the loop 5 is formed.

In this respect, the region of the strap 3 originating from the sole 2 is called the proximal strap section 8, whereas the section extending from the loop 5 to the end of the strap 3 remote from the sole 2 is called the distal section 9. The proximal section 8 and the distal section 9 are here separated by the fastening region 4 of the loop 5.

The loop 5 can be placed such that a first planar side 6 of the belt 3 faces a second planar side 7 of the strap 3, or even contacts it, in the fastening region 4. Provision can additionally be made that the leadthrough opening of the loop 5 is reduced in its opening. It can, for example, be implemented in that two mutually facing regions of the second planar side are fastened to one another in the loop region.

In the present case, the fixing of the two strap sections for forming the loop 5 is performed by sewing, but with other alternative fastenings likewise being conceivable.

The angle $\alpha$ the proximal section 8 and the distal section 9 include with one another due to the placed loop 5 is at approximately 120° in FIG. 2.

Figure 3:
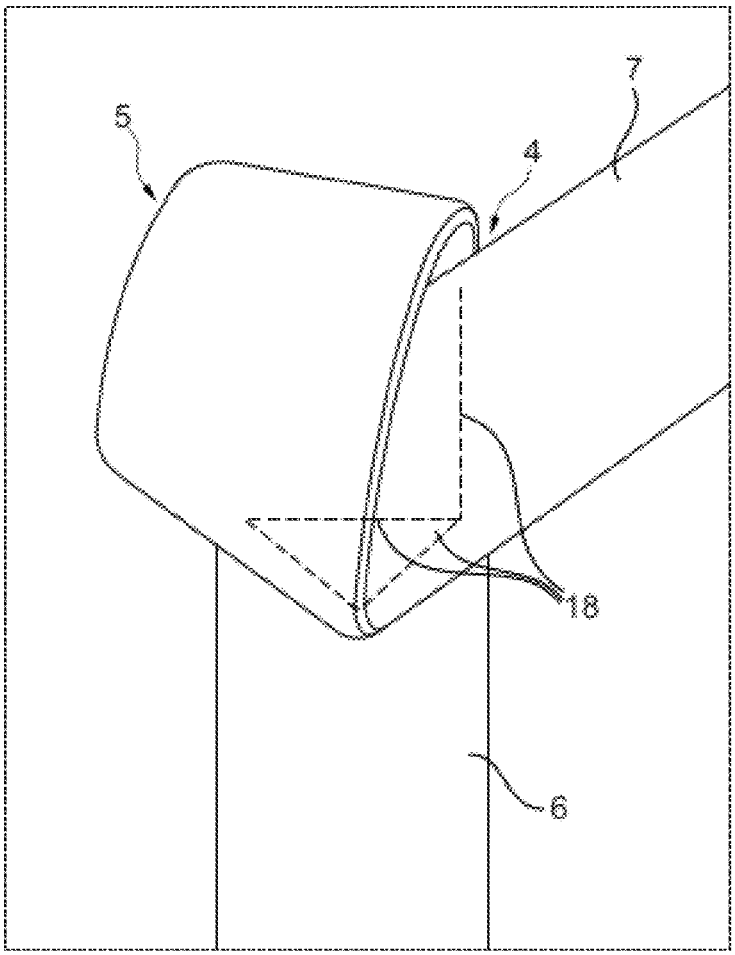
FIG. 3: a loop section of the strap in an enlarged representation from an outer side.

FIG. 3 shows a loop section of the strap in an enlarged illustration from an outer side, that is from that side toward which the loop 5 rises.

It can be recognized that the loop 5 is fixed by a seam 18 in the fastening region 4. In this respect, two sections spaced apart from one another in the longitudinal direction of the strap 3 are sewed to one another to fix the loop 5.

The seam 18 can here not only be used to form the loop 5, but can also simultaneously define the passage opening of the loop 5. It can be recognized in the present case that the opening of the loop 5 has been reduced in size, likewise by sewing, in the lower region of the loop 5 that faces the proximal section 8 of the strap 3. This seam reducing the size of the opening of the loop 5 extends here substantially perpendicular to the longitudinal direction of the proximal section 8 and can result in a direction orientation of the strap 3 pushed through the loop 5.

Figure 4:
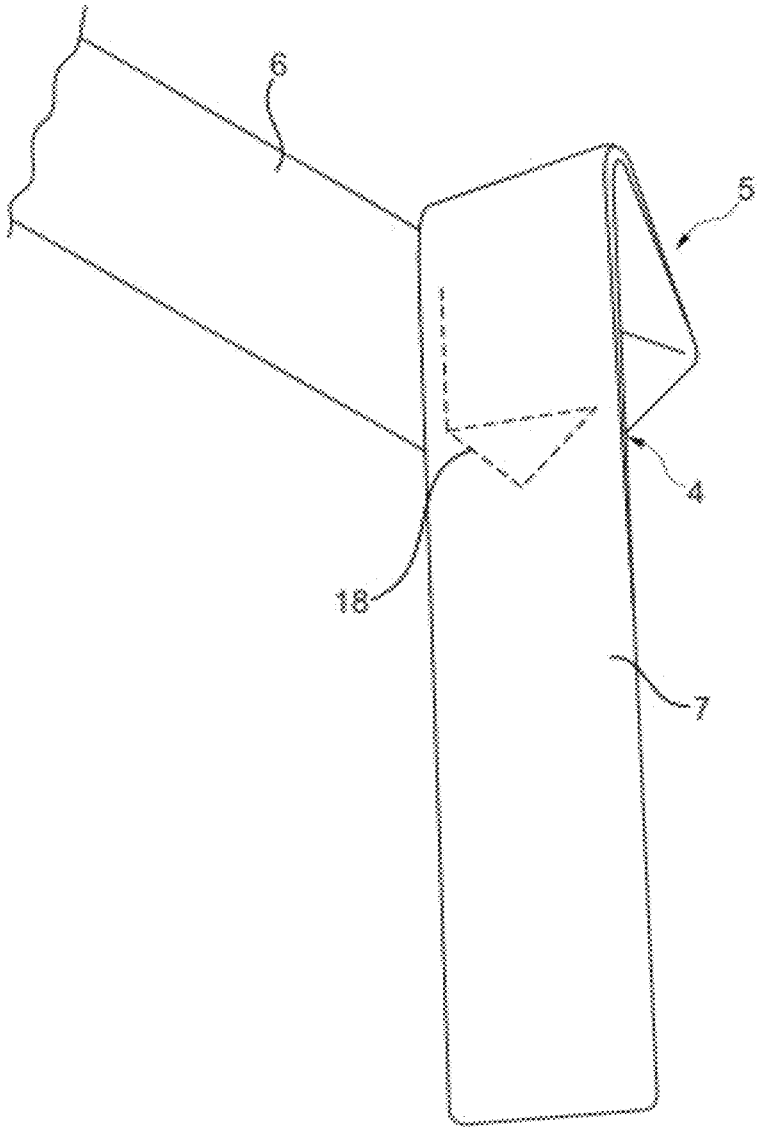
FIG. 4: a loop section of the strap in an enlarged representation from an inner side.

FIG. 4 shows a loop section of the strap in an enlarged illustration from an inner side, that is from that side from which the loop 5 is led away. The seam 18 in the fastening region 4 can be recognized here.

Figure 5:
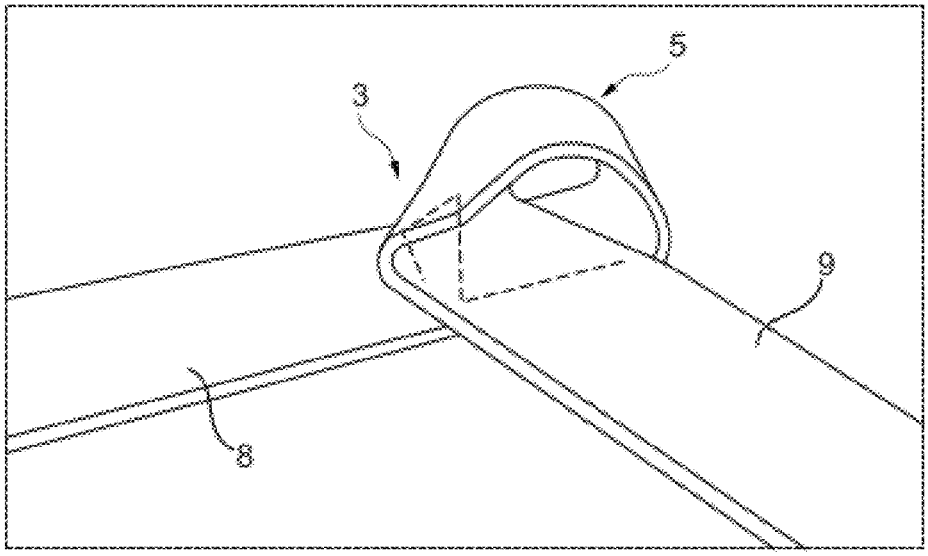
FIG. 5: a loop section in a perspective view with its leadthrough opening.

FIG. 5 shows a loop section in a perspective view with its leadthrough opening. The leadthrough opening is designed here such that a strap 3 can be led through to deflect it at the loop 5.

Figure 6:
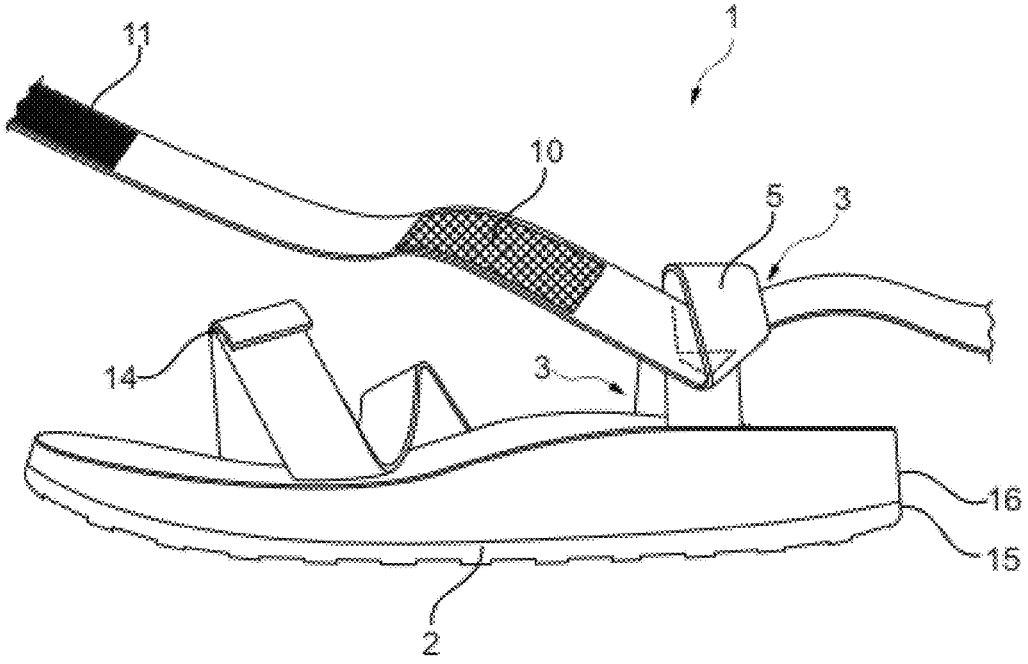
FIG. 6 a side view of a sandal in accordance with the invention.

FIG. 6 shows a side view of a sandal 1 in accordance with the invention. It can be recognized that the sole 2 has a multi-layer design with at least two layers 15, 16. Two straps 3 rise from the sole 2 and have two components of a strap fixing belonging to one another at the distal section 9 after their loop 5. In the present case, this strap fixing is carried out by a hook and loop connection so that a hook tape 10 having an associated loop tape 11 is arranged at one of the two planar sides of the distal strap section 9.

Provision is made to lead the respective distal section 9 of a strap 3 through the loop 5 of the other strap 3 and to deflect the strap there so that the strap fixing can be performed, for example so that the hook tape can be fixed to the loop tape.

Figure 7:
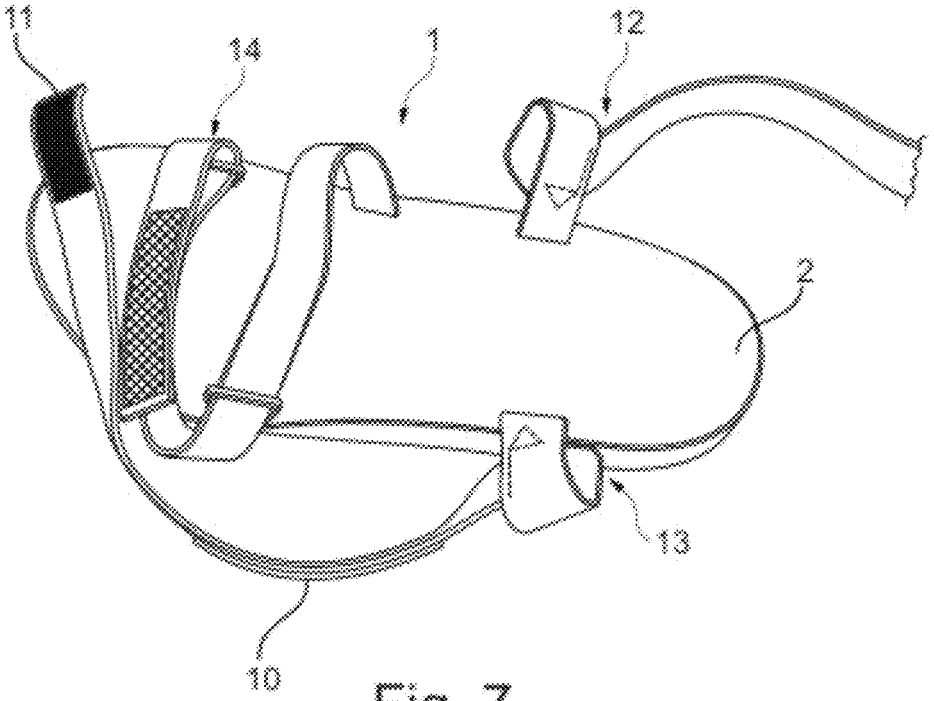
FIG. 7 a plan view of a sandal in accordance with the invention.

FIG. 7 shows a plan view of a sandal 1 in accordance with the invention. It can be recognized that the outer strap is provided with a strap fixing 10, 11 that the inner strap 12 also has (only partially shown). A front foot strap 14 is connected to the sole 2 to hold a front region of a foot in the sandal 1.

Figure 8:
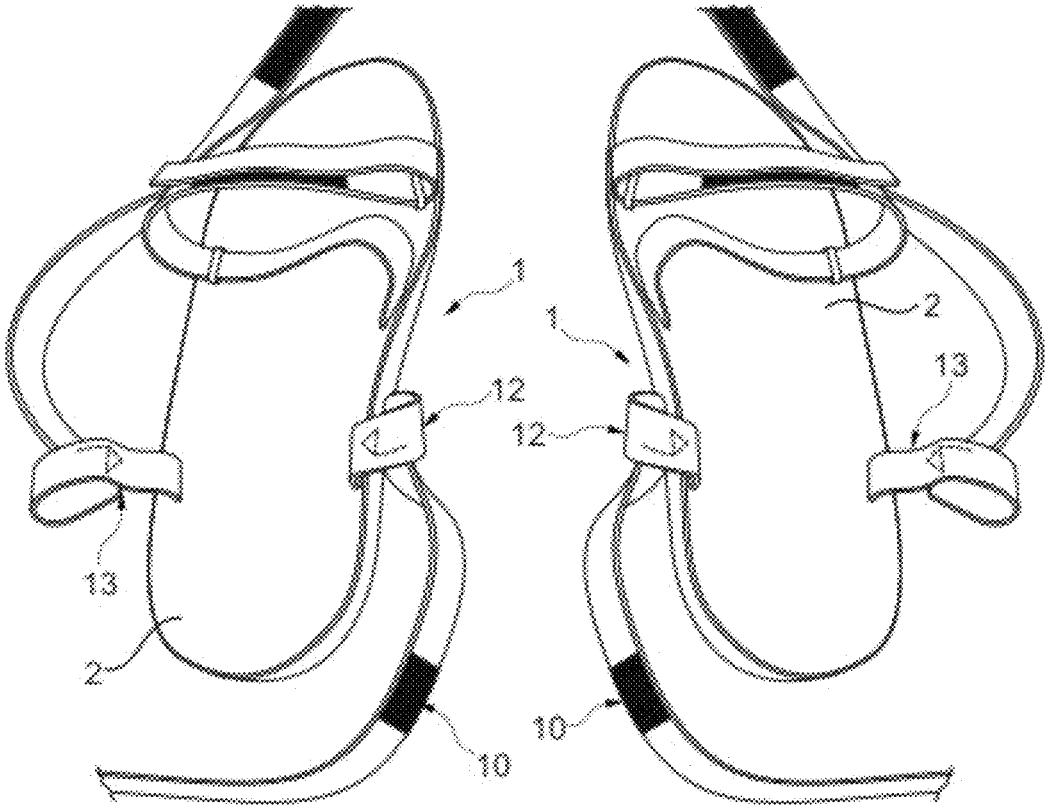
FIG. 8 a plan view of a pair of sandals in accordance with the invention.

FIG. 8 shows a plan view of a pair of sandals 1 in accordance with the invention in which the differences of the straps 3 used can be recognized. It can thus be seen that both the inner strap 12 and the outer strap 13 of a common sandal 1 are each provided with a loop 5 that is placed in a common direction. The other sandal 1 of the pair in contrast has an inner strap 12 and an outer strap 13 having a loop 5 that is placed in the other direction.

REFERENCE NUMERAL LIST

1 sandal
2 sole
3 strap
4 fastening region
5 loop
6 first planar side of the strap
7 second planar side of the strap
8 proximal strap section
9 distal strap section
10 hook tape
11 loop tape
12 inner strap
13 outer strap
11 front foot fastening strap
15 layer of the sole facing the floor
16 layer of the sole remote from the floor
17 fastening element
18 seam
α angle between the proximal and distal strap sections

The invention claimed is:

1. A sandal, comprising:
a sole separating a foot surface and a floor; and
at least one strap that is connected to the sole and serves as a fastening of the foot in the sandal;
wherein a strap of the at least one strap forms a loop in a first section to deflect a second section of the strap of the at least one strap guided through the loop in a fastening region by fastening the first and second strap sections to one another;
wherein the strap has a first side and a second side, wherein the first side and the second side are opposite faces of the strap; and
wherein the loop has a first bend and a second bend, wherein the second bend is vertically below the first bend and the first side and the second side are in face sharing contact in an area between the first bend and the second bend.

2. The sandal in accordance with claim 1, wherein the strap extends in a straight line perpendicular from the sole and includes an angle (α) after the loop with the first section extending from the sole in a range from 90° to 160°.

3. The sandal in accordance with claim 1, wherein the first and second strap sections fastened to one another are adhesively bonded, welded, riveted, and/or sewn to one another to form the loop.

4. The sandal in accordance with claim 1, wherein
the loop divides the strap into a proximal strap section that extends toward the loop, starting from the sole, and a distal strap section that extends from the loop toward an end region of the strap extending away from the sole; and
the distal strap section has two components of a strap fixing at a first planar side of the distal strap section, wherein a first component of the two components is located proximate the loop and a second component of the two components is located at an opposite end of the distal strap section from the first component.

5. The sandal in accordance with claim 1, wherein the loop is remote from a longitudinal axis of the sole.

6. The sandal in accordance with claim 1, wherein the strap of the at least one strap is arranged in a rear region of the sole.

7. The sandal in accordance with claim 1, wherein the loop of the strap of the at least one strap is designed such that it has an opening wider than a width of the strap in a flattened state.

8. The sandal in accordance with claim 1, wherein the at least one strap comprises at least two straps, an inner strap and an outer strap, wherein the inner strap and the outer strap are attached opposite each other, one on each side of a width of the sole, wherein respective distal sections of each of the inner strap and the outer strap can be guided across the sandal, through the loop of the opposite strap.

9. The sandal in accordance with claim 8, wherein
the inner strap is adapted to be guided over a rear side of the foot above a heel in a region of an Achilles tendon; and/or
the outer strap is adapted to be guided over an instep region of the foot.

10. The sandal in accordance with claim 8, wherein the inner strap is shorter in a longitudinal extent than the outer strap, the distal section of the inner strap that is subsequent to the loop of the strap is shorter in a longitudinal extent than the distal section of the outer strap.

11. The sandal in accordance with claim 1, further having a front foot fastening strap for fastening a front foot to the sandal.

12. The sandal in accordance with claim 1, wherein the sole has a multi-layer design with a layer facing the floor and a layer remote from the floor, with the at least one strap being fastened between two of the layers.

13. The sandal of claim 1, wherein the loop is formed such that in the fastening region, a first portion of the first side is in face sharing contact with a second portion of the first side.

14. A sandal pair having a pair of sandals, wherein each sandal comprises:

a sole separating a foot surface and a floor; and at least two straps are connected, opposite each other, one on each side of a width of the sole and serve as a fastening of the foot in the sandal;

wherein each strap respectively forms a loop in a first section that is adapted to deflect a second section of the respective strap guided through the loop in a fastening region by fastening the first and second strap sections to one another;

wherein the at least two straps comprise an inner strap and an outer strap, and wherein each of the inner strap and the outer strap can be guided through a loop of the opposite strap; and wherein the loops of the inner strap and of the outer strap of the one sandal of the pair of sandals are placed in one direction and the loops of the inner strap and of the outer strap of the other sandal of the pair of sandals are placed in the other direction.

* * * * *